US010741319B2

(12) United States Patent
Maeda et al.

(10) Patent No.: US 10,741,319 B2
(45) Date of Patent: Aug. 11, 2020

(54) THREE-PHASE REACTOR

(71) Applicant: FANUC CORPORATION, Minamitsuru-gun, Yamanashi (JP)

(72) Inventors: Takuya Maeda, Yamanashi (JP); Chao Zhi, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 222 days.

(21) Appl. No.: 16/023,547

(22) Filed: Jun. 29, 2018

(65) Prior Publication Data

US 2019/0019611 A1 Jan. 17, 2019

(30) Foreign Application Priority Data

Jul. 12, 2017 (JP) ..... 2017-136215

(51) Int. Cl.

| | |
|---|---|
| ***H01F 27/30*** | (2006.01) |
| ***H01F 27/24*** | (2006.01) |
| ***H01F 27/28*** | (2006.01) |
| ***H01F 3/10*** | (2006.01) |
| ***H01F 37/00*** | (2006.01) |
| *H01F 27/32* | (2006.01) |
| *H01F 27/02* | (2006.01) |
| *H01F 3/14* | (2006.01) |

(52) U.S. Cl.

CPC ..... *H01F 27/24* (2013.01); *H01F 3/10* (2013.01); *H01F 27/28* (2013.01); *H01F 37/00* (2013.01); *H01F 3/14* (2013.01); *H01F 27/02* (2013.01); *H01F 27/321* (2013.01)

(58) Field of Classification Search

CPC ..... H01F 27/24; H01F 27/321; H01F 27/28; H01F 27/263; H01F 27/306; H01F 27/12; H01F 27/25; H01F 3/14; H01F 3/10; H01F 2003/106

USPC ..... 336/5, 170, 184, 212–215, 221

See application file for complete search history.

(56) References Cited

U.S. PATENT DOCUMENTS

| | | | | |
|---|---|---|---|---|
| 4,419,648 | A | 12/1983 | Seipel | |
| 7,148,782 | B2 * | 12/2006 | Hirzel | H01F 27/25 336/212 |
| 10,256,737 | B2 * | 4/2019 | Yang | H02J 7/00 |
| 2003/0112111 | A1 * | 6/2003 | Bolotinsky | H01F 27/25 336/170 |
| 2014/0268896 | A1 * | 9/2014 | Kurita | H01F 37/00 363/17 |

(Continued)

FOREIGN PATENT DOCUMENTS

| | | | |
|---|---|---|---|
| CN | 2575820 | Y | 9/2003 |
| CN | 105990003 | A | 10/2016 |

(Continued)

*Primary Examiner* — Tszfung J Chan
(74) *Attorney, Agent, or Firm* — RatnerPrestia

(57) ABSTRACT

A three-phase reactor according to an embodiment includes a first plate iron core and a second plate iron core disposed oppositely to each other; a plurality of cylindrical iron cores disposed between the first plate iron core and the second plate iron core orthogonally to the first plate iron core and the second plate iron core, the iron cores being disposed rotationally symmetrically with respect to an axis equidistant from central axes of the iron cores, as a rotation axis; and a plurality of coils each wound on each of the iron cores.

11 Claims, 13 Drawing Sheets

(56) References Cited

U.S. PATENT DOCUMENTS

| | | | | |
|---|---|---|---|---|
| 2014/0292455 | A1* | 10/2014 | Kurita | H01F 3/14 336/5 |
| 2015/0179330 | A1* | 6/2015 | Nakanoue | H01F 37/00 336/5 |
| 2015/0213943 | A1 | 7/2015 | Fogelberg | |

FOREIGN PATENT DOCUMENTS

| | | | |
|---|---|---|---|
| CN | 206163266 | U | 5/2017 |
| EP | 2584572 | A1 | 4/2013 |
| FR | 1164604 | A | 10/1958 |
| JP | 36029937 | Y2 | 11/1961 |
| JP | S59217313 | A | 12/1984 |
| JP | H01315116 | A | 12/1989 |
| JP | H03141623 | A | 6/1991 |
| JP | 2009-283706 | A | 12/2009 |
| WO | 2011158290 | A1 | 12/2011 |
| WO | 2012/157053 | | 11/2012 |
| WO | 2013065095 | A1 | 5/2013 |
| WO | 2014167571 | A1 | 10/2014 |

* cited by examiner

THREE-PHASE REACTOR

This application is a new U.S. patent application that claims benefit of JP 2017-136215 filed on Jul. 12, 2017, the content of 2017-136215 is incorporated herein by reference.

BACKGROUND OF THE INVENTION

1. Field of the Invention

The present invention relates to a three-phase reactor, and more specifically relates to a three-phase reactor having balanced three-phase inductance.

2. Description of Related Art

Reactors are used in order to reduce harmonic current occurring in inverters, etc., to improve input power factors, and to reduce inrush current to the inverters. The reactor has iron cores made of a magnetic material and coils formed on outer peripheries of the iron cores.

Reactors having linearly arranged windings are reported so far (for example, Japanese Unexamined Patent Publication (Kokai) No. JP 2009-283706, hereinafter referred to as "Patent Document 1"). A reactor according to Patent Document 1 has a heatsink, a plurality of windings arranged on the heatsink, and a biasing means for biasing the windings toward the heatsink. The reactor according to Patent Document 1 has a problem that, since three-phase power is asymmetrical, various values, including magnetic flux, do not become completely uniform. Owing to the unbalanced three-phase power, heat generation, leakage flux (tend to have a coupling coefficient of approximately 0.3, which is lower than its ideal value 0.5), noise, electromagnetic waves may be produced. Thus, in large-sized potential reactors, fences are required to be provided to keep people away from the potential reactors. With an increase in the number of devices using electromagnetic waves, such as cellular phones, demands for the electromagnetic waves are increased more and more. The leakage flux may have adverse effects on heart pacemakers.

Reactors having three-phase coils arranged in circumferences are reported too (for example, International Publication No. WO 2012/157053, hereinafter referred to as "Patent Document 2"). A reactor according to Patent Document 2 includes two yoke cores disposed oppositely, three magnetic pole cores that have coils wound thereon and gap regulation means, and three zero-phase magnetic pole cores having no coil wound thereon. The two opposite yoke cores are connected each other through the three magnetic pole cores and the three zero-phase magnetic pole cores. The three magnetic pole cores are arranged in a circumference at a certain angle with respect to a concentric axis of the yoke cores. The three zero-phase magnetic pole cores are each disposed between the magnetic pole cores with respect to the concentric axis of the yoke cores. Owing to the three zero-phase magnetic pole cores, magnetic flux flows into the zero-phase magnetic pole cores and hardly flows into the other phases, thus causing a reduction in mutual inductance. Therefore, this structure is unsuitable for use of the mutual inductance.

In the reactor of Patent Document 2, each core is made of a sheet metal wound into a roll, and hence magnetic flux tends to flow in the form of the roll. Therefore, in the cores, a magnetic flux path is not likely to have a shortest and minimum magnetic resistance, and is likely to have a low mutual inductance and a low self-inductance. The reactor also has the problem in manufacture and assembly that the reactor is unsuitable for drilling, tapping, etc. Therefore, for example, an inductance regulation mechanism (a screw, etc.) is difficult to use in the reactor. Furthermore, it is difficult to prevent magnetic flux produced by the coils from leaking outside.

SUMMARY OF THE INVENTION

The present invention aims at providing a three-phase reactor that has a reactance having an increased inductance, by taking advantage of a mutual inductance, owing to balanced three-phase power, as well as taking advantage of a self-inductance.

A three-phase reactor according to an embodiment includes a first plate iron core and a second plate iron core disposed oppositely to each other; a plurality of cylindrical iron cores disposed between the first plate iron core and the second plate iron core orthogonally to the first plate iron core and the second plate iron core, the iron cores being disposed rotationally symmetrically with respect to an axis equidistant from central axes of the iron cores, as a rotation axis; and a plurality of coils each wound on each of the iron cores.

BRIEF DESCRIPTION OF THE DRAWINGS

The objects, features, and advantages of the present invention will become more apparent from the following description of embodiments along with accompanying drawings. In the accompanying drawings.

DETAILED DESCRIPTION OF THE INVENTION

A three-phase reactor according to the present invention will be described below with reference to the drawings.

However, the technical scope of the present invention is not limited to its embodiments, but embraces invention described in claims and equivalents thereof.

Figure 1:
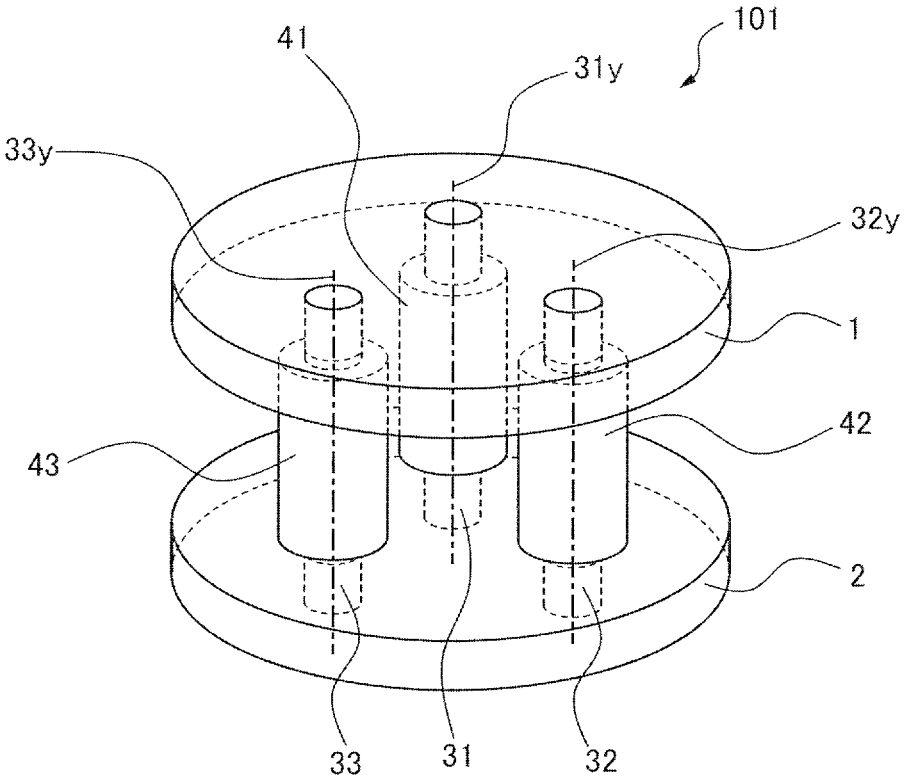
FIG. 1 is a perspective view of a three-phase reactor according to a first embodiment.

A three-phase reactor according to a first embodiment will be described. FIG. 1 is a perspective view of the three-phase reactor according to the first embodiment. A three-phase reactor 101 according to the first embodiment includes a first plate iron core 1, a second plate iron core 2, a plurality of iron cores (31, 32, and 33), and a plurality of coils (41, 42, and 43).

The first plate iron core 1 and the second plate iron core 2 are iron cores disposed oppositely to each other. In the example of FIG. 1, each of the first plate iron core 1 and the second plate iron core 2 has a disc shape, but not limited to this example, and may have an elliptical shape or a polygonal shape. The first plate iron core 1 and the second plate iron core 2 are preferably made of a magnetic material.

The cores (31, 32, and 33) are cylindrical iron cores disposed between the first plate iron core 1 and the second plate iron core 2, in such a manner that central axes (31*y*, 32*y*, and 33*y*) are orthogonal to the first plate iron core 1 and the second plate iron core 2. The number of the iron cores is three in the example of FIG. 1, but the present invention is not limited to this example. For example, axisymmetrically disposed six cores may be connected in series or in parallel so as to constitute one reactor, or may directly have six wires to constitute two reactors. In the case of a single phase, the number of cores may be two. The coils (41, 42, and 43) are preferably disposed inside end portions of the first plate iron core 1 and the second plate iron core 2 disposed oppositely.

Each of the cores (31, 32, and 33) has a circular cylindrical shape in the example of FIG. 1, but may have an elliptical cylindrical shape or a polygonal cylindrical shape or columnar shape.

Figure 2:
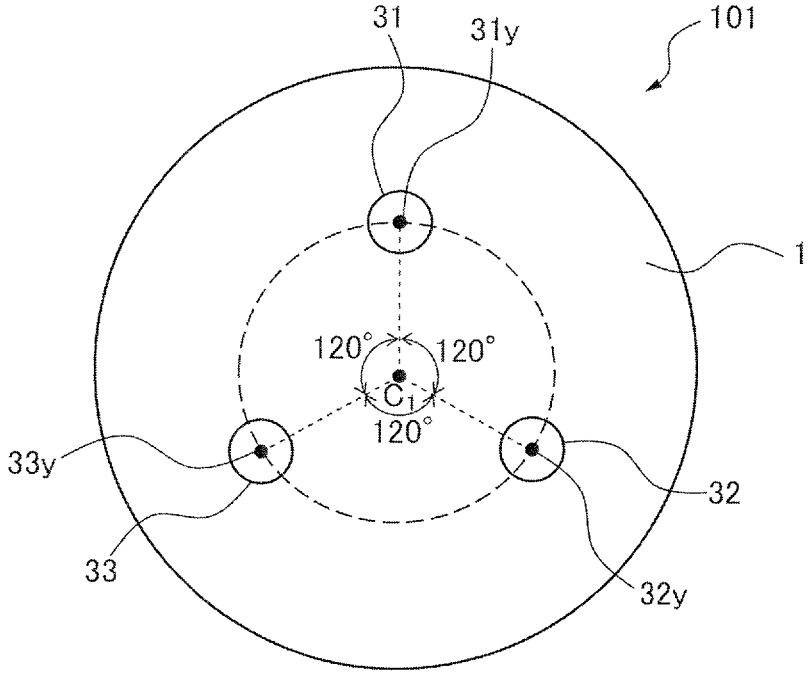
FIG. 2 is a plan view of the three-phase reactor according to the first embodiment.

FIG. 2 is a plan view of the three-phase reactor according to the first embodiment. FIG. 2 is a plan view of the three-phase reactor illustrated in FIG. 1, viewed from the side of the first plate iron core 1. The cores (31, 32, and 33) are disposed rotationally symmetrically with respect to an axis that is equidistant from the central axes (31*y*, 32*y*, and 33*y*) of the iron cores (31, 32, and 33), as a rotation axis $C_1$. When the number of the iron cores is three, as shown in FIG. 2, the iron cores (31, 32, and 33) are disposed rotationally symmetrically with respect to the rotation axis $C_1$, such that the central axes (31*y*, 32*y*, and 33*y*) of the iron cores (31, 32, and 33) are 120° out of phase with each other. This structure eliminates an unbalanced state between three phases.

The rotation axis $C_1$ may coincide with a central axis of the first plate iron core 1 or the second plate iron core 2.

Figure 3:
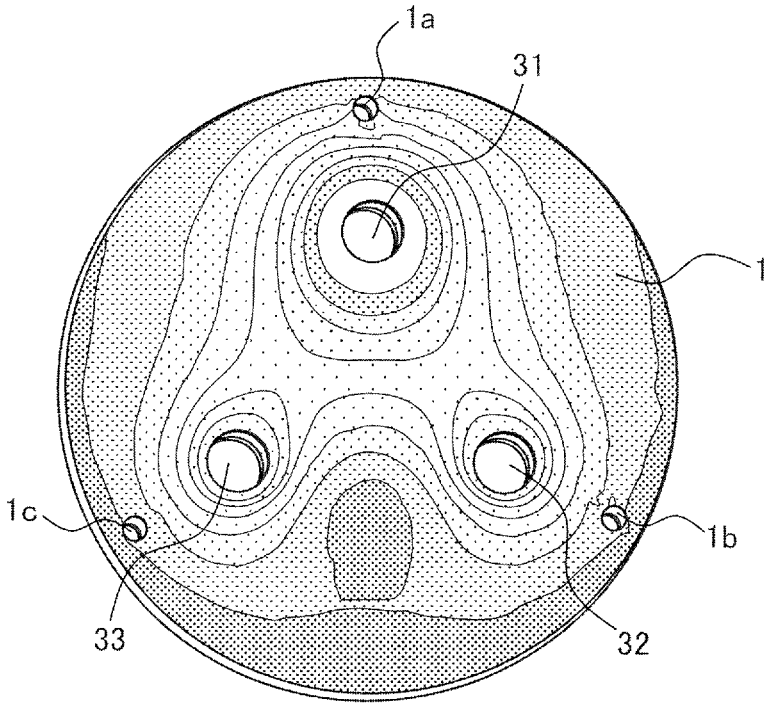
FIG. 3 is a drawing illustrating a magnetic analysis result in a first plate iron core in the three-phase reactor according to the first embodiment.

FIG. 3 is a drawing illustrating a magnetic analysis result in a certain phase of three-phase alternating current in the first plate iron core in the three-phase reactor according to the first embodiment. In the phase, a maximum current flows through the coil wound on the iron core 31, and currents at the levels of half the maximum current flow through the iron cores 32 and 33 in opposite directions. Therefore, magnetic flux extends from the iron core 31 to the iron cores 32 and 33. The density of the magnetic flux is high in the vicinity of the iron core 31, and is reduced with an increase in distance from the iron core 31. Since the whole of first plate iron core is widely used without waste, the effect of magnetic saturation is lowered, and an inductance is unlikely to be reduced. Since the iron cores (31, 32, and 33) produce general three-phase magnetic flux, magnetic flux produced by a certain core flows through the other cores. Therefore, not only a self-inductance but also a mutual inductance is actively used. The inductance is calculated by the following equation.

$$\text{Inductance}=\text{Self-inductance}+\text{Mutual Inductance}$$

As a result, the mutual inductance can be effectively used.

According to the structure of FIG. 3 in which the magnetic flux flows through a middle portion of the first plate iron core 1, since magnetic flux produced by the iron core 31 reaches the first plate iron core 1 and linearly flows into the other iron cores (32 and 33), the magnetic flux flows efficiently, thus offering an improvement in the mutual inductance.

Figure 4:
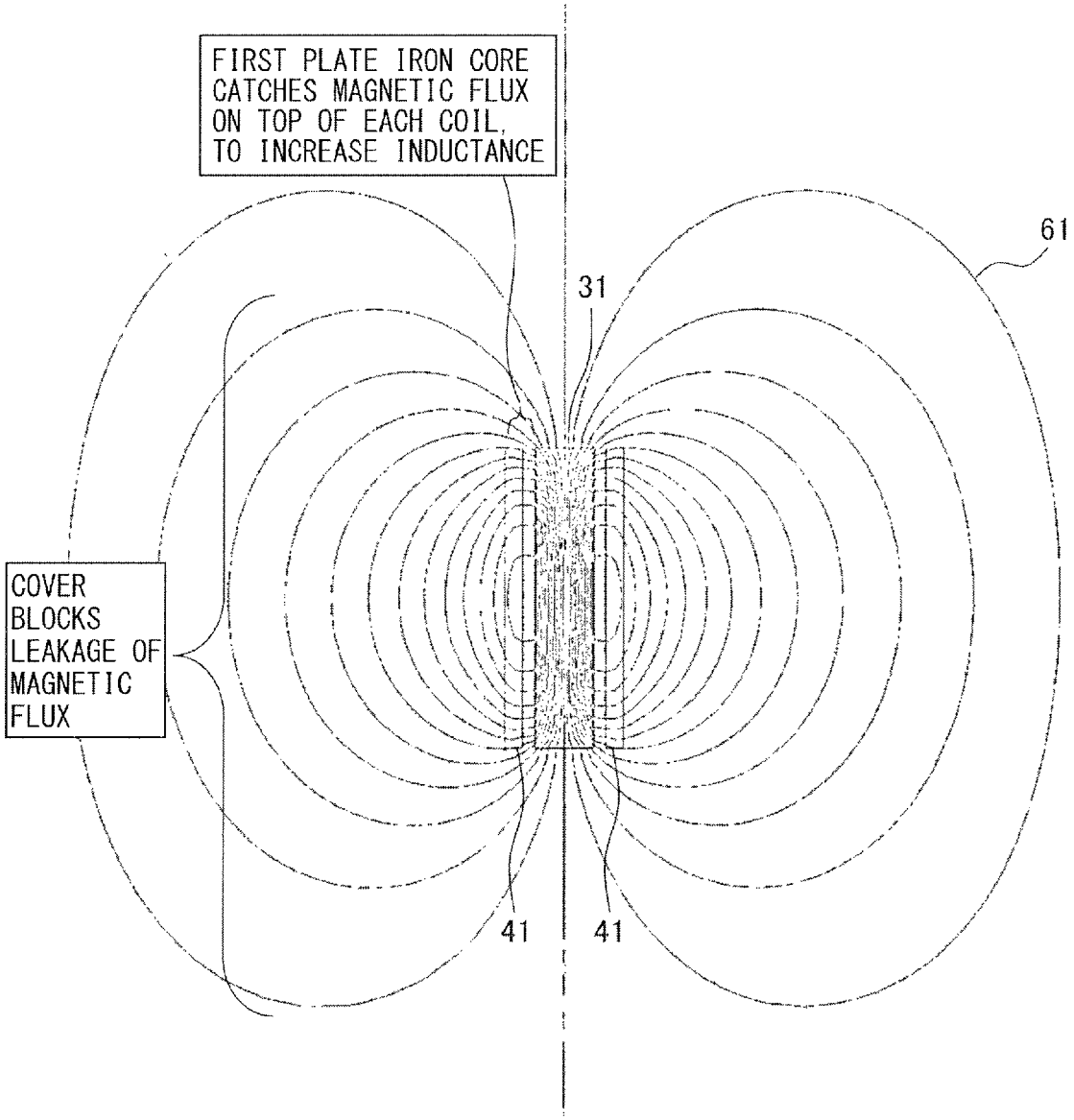
FIG. 4 is a drawing illustrating lines of magnetic flux of a core coil of the three-phase reactor according to the first embodiment.

FIG. 4 is a drawing illustrating lines of magnetic flux of a core coil. FIG. 4 illustrates lines 61 of magnetic flux produced by the iron core 31 on which the coil 41 is wound. It is apparent from FIG. 4 that disposing the first plate iron core 1 over the coils (41, 42, and 43), to catch magnetic flux that generally leaks from the top of every coil, brings about an improvement in the mutual inductance, as well as an improvement in the self-inductance. The same is true for the second plate iron core 2. Furthermore, a cover described later can block leakage of the magnetic flux.

It is apparent from the magnetic analysis result of FIG. 3 that, even in the case of two cores of a single phase, a mutual inductance can be increased using the first plate iron core 1, based on the magnetic flux around the iron cores (31, 32, and 33) and a flow of the bulging magnetic flux between the iron cores.

Furthermore, as is apparent from FIG. 3, providing screw holes (1*a*, 1*b*, and 1*c*) used by gap regulation mechanisms described later, a tap hole, etc., in positions that have no effect on magnetic flux does not cause a reduction in the inductance.

Using the iron cores (31, 32, and 33) made of magnetic steel sheets laminated in an axial direction, magnetic flux flows more easily than in using wound iron cores.

The first plate iron core 1, the second plate iron core 2, and the iron cores (31, 32, and 33) can be fitted to each other. For example, the first plate iron core 1 and the second plate iron core 2 may be provided with openings to fit the iron cores (31, 32, and 33) therein, and the iron cores (31, 32, and 33) may be fitted into the openings. However, in consideration of the size of the reactor depending on its application, the first plate iron core 1, the second plate iron core 2, and the iron cores (31, 32, and 33) may be coupled by another method. For example, the first plate iron core 1, the second plate iron core 2, and the iron cores (31, 32, and 33) may be screwed for reinforcement.

In the above description, neither the first plate iron core 1 nor the second plate iron core 2 has an opening, but at least one of the first plate iron core 1 and the second plate iron core 2 may have an opening at its middle portion.

In the above description, none of the iron cores (31, 32, and 33) has a gap, but at least one of the iron cores (31, 32, and 33) may have a first gap. The first gap may be formed between surfaces orthogonal to a longitudinal direction of the iron cores (31, 32, and 33). The first gap is preferably provided in a middle portion of each of the iron cores (31, 32, and 33). A magnetic resistance is calculated by the length, magnetic permeability, and cross sectional area of a magnetic path. The magnetic permeability of an iron core is of the order of approximately 1000 times larger than that of air. Thus, in a core-type reactor having a gap, an air portion, i.e., a gap portion, constitutes a main magnetic resistance, and the magnetic resistance of an iron core portion is negligible. In a core-type reactor having no gap, an iron core portion constitutes a magnetic resistance. Only providing the air portion, i.e., the gap portion, significantly varies a physical property in a flow of magnetic flux, due to the difference in magnetic permeability, thus serving different applications. A current to saturate the iron core is largely different too, and therefore reactors can be used in variety of applications.

Figure 5:
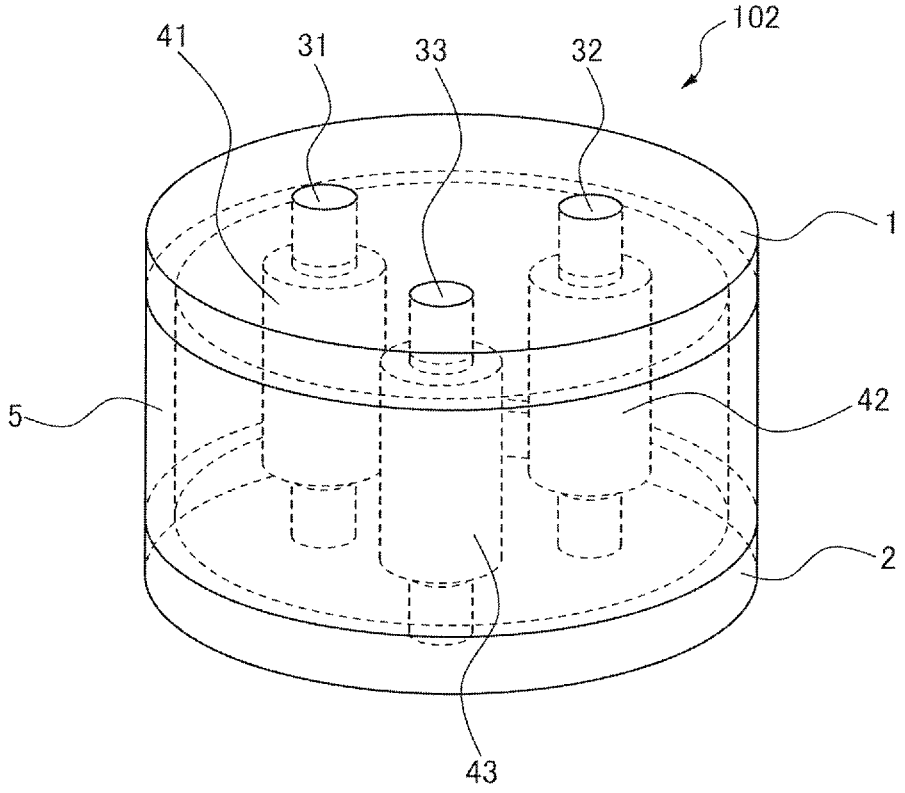
FIG. 5 is a perspective view of a three-phase reactor according to a second embodiment.

Next, a three-phase reactor according to a second embodiment will be described. FIG. 5 is a perspective view of the three-phase reactor according to the second embodiment. The difference between a three-phase reactor 102 according to the second embodiment and the three-phase reactor 101 according to the first embodiment is that the three-phase reactor 102 further includes a cover 5 provided in outer peripheries of the first plate iron core 1 and the second plate iron core 2. The other structure of the three-phase reactor 102 according to the second embodiment is the same as that of the three-phase reactor 101 according to the first embodiment, so a detailed description thereof is omitted.

In a reactor, when an iron core has a gap, a suction force occurs in the gap portion in an axial direction of the iron core. To support the structure against the suction force, a cover 5 is provided. The cover 5 is made of any of iron, aluminum, and resin. Alternatively, the cover 5 may be made of a magnetic material or a conductive material.

Figure 6A:
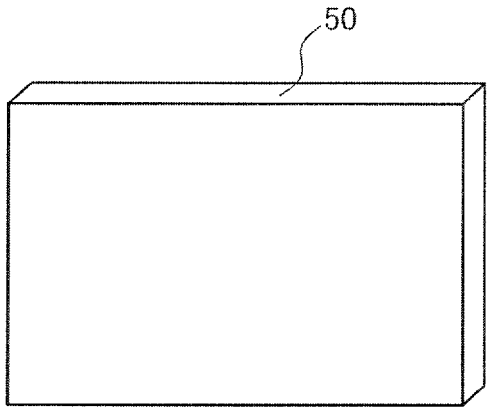
FIG. 6A is a perspective view of a base material of a cover for the three-phase reactor according to the second embodiment.

FIG. 6A is a perspective view of a base material of a cover for the three-phase reactor according to the second embodiment. As a base material 50, a ferromagnetic sheet is preferably used. As the ferromagnetic sheet, for example, an electromagnetic steel sheet can be used. Insulation processing is preferably applied to a surface of the base material 50.

Figure 6B:
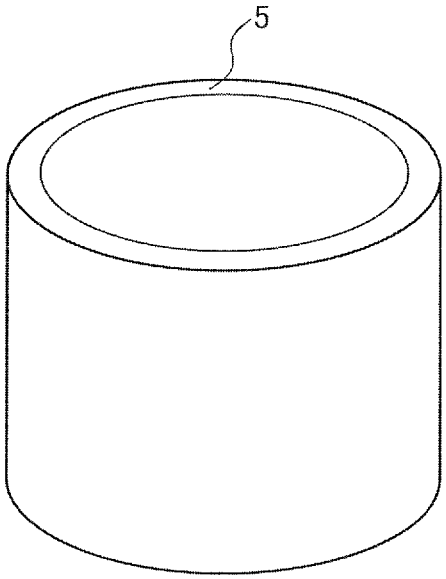
FIG. 6B is a perspective view of the cover for the three-phase reactor according to the second embodiment.

FIG. 6B is a perspective view of a cover for the three-phase reactor according to the second embodiment. By bending the rectangular base material 50, illustrated in FIG. 6A, along the outer peripheries of the first plate iron core 1 and the second plate iron core 2, a cylindrical cover 5 can be formed, as shown in FIG. 6B. In the case of a reactor of a small diameter, the cylindrical cover 5 can be formed by winding the base material 50 around a tubular member. The cover may be made of a carbon steel, etc., instead of the electromagnetic steel sheet. The cylindrical cover 5 can be easily machined with a lathe, and hence has advantages in cost and machining and manufacturing accuracy. The cylindrical cover 5 is preferable in term of enabling disposition of maximum possible iron cores, coils, etc., because a cylindrical shape has a maximum volume size among shapes having the same circumferential length, in term of reducing the amount of a material to be used, and in term of reasonableness in a life cycle of a product.

The outer peripheries of the first plate iron core 1 and the second plate iron core 2 are preferably circular or elliptical in shape. In the same manner as the cover 5, forming the first plate iron core 1 and the second plate iron core 2 in a simple shape, such as a round, an ellipse, etc., allows processing and manufacturing with high accuracy. Thus, by combination of the iron cores (31, 32, and 33), the first plate iron core 1, the second plate iron core 2, and the cover 5 that are processed with high accuracy, a gap formed in the iron core is easily controlled so as to be kept at constant dimensions. As a result, it is possible to reduce variations in a gap length, owing to a suction force exerted on the gap. However, this function can be performed, without using the cover 5 of a cylindrical shape, and without using the first plate iron core 1 and the second plate iron core 2 of round or elliptical shapes.

The cover 5 made of iron, aluminum, etc., can prevent magnetic flux and electromagnetic waves from leaking outside. The cover 5 made of a magnetic material, such as iron, functions as a path of the magnetic flux, and prevents leakage flux from getting outside. Noise, such as electromagnetic waves, can be also prevented from leaking outside. Furthermore, the cover 5 made of iron, aluminum, etc., can reduce eddy current, and improve ease of passage of the magnetic flux.

The cover 5 made of a material having a low magnetic permeability and a low resistivity, such as aluminum, can block electromagnetic waves. In general, three-phase alternating current is formed by switching elements, such as IGBT (insulated gate bipolar transistor) elements, and a rectangular electromagnetic wave may become a problem in an EMC (electromagnetic compatibility) test, etc. The cover 5 made of resin, etc., can prevent entry of liquid, foreign matter, etc.

In conventional art, an example in which zero-phase magnetic pole cores are provided as a measure against direct current magnetic flux, not zero-phase, i.e., three-phase alternating current magnetic flux, is reported. On the other hand, in this embodiment, as illustrated in the magnetic analysis result of FIG. 3, magnetic flux does not reach the cover 5. However, when direct current magnetic flux flows, the unbalanced magnetic flux may reach the cover, in the same manner as leakage flux. The cover 5 made of a magnetic material can absorb the unbalanced magnetic flux, thus eliminating adverse effects. A case in which direct current magnetic flux is overlaid on three-phase alternating current for some reason is conceivable.

Figure 7:
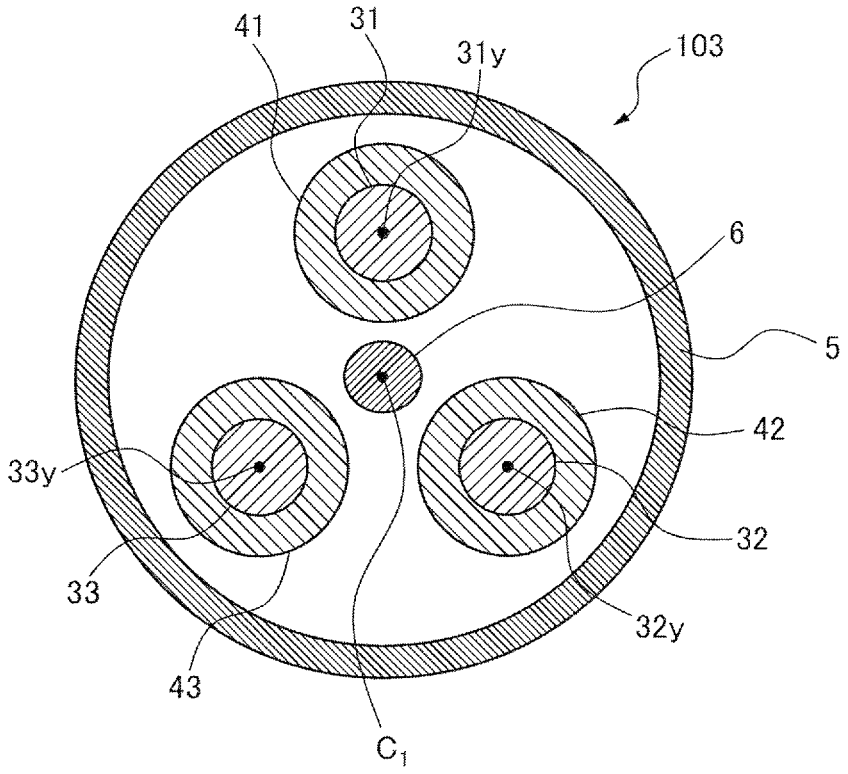
FIG. 7 is a cross sectional view of a three-phase reactor according to a third embodiment.

Next, a three-phase reactor according to a third embodiment will be described. FIG. 7 is a cross sectional view of the three-phase reactor according to the third embodiment. In the cross sectional view of FIG. 7, the cores (31, 32, and 33) having the coils (41, 42, and 43) wound thereon, as illustrated in FIG. 5, are sectioned in an arbitrary position by a plane parallel to the first plate iron core 1. The difference between a three-phase reactor 103 according to the third embodiment and the three-phase reactor 101 according to the first embodiment is that the three-phase reactor 103 further includes a rod member 6 disposed such that an axis (rotation axis $C_1$) equidistant from the central axes (31*y*, 32*y*, and 33*y*) of the iron cores (31, 32, and 33) coincides with a central axis of the rod member 6. The other structure of the three-phase reactor 103 according to the third embodiment is the same as that of the three-phase reactor 101 according to the first embodiment, so a detailed description thereof is omitted.

The rod member 6 is preferably disposed such that the axis (rotation axis $C_1$) equidistant from the central axes (31*y*, 32*y*, and 33*y*) of the iron cores (31, 32, and 33) coincides with the central axis of the rod member 6, based on the disposition of the iron cores (31, 32, and 33) having the coils (41, 42, and 43) wound thereon and the shapes of the first plate iron core 1 and the second plate iron core 2. The rod member 6 is preferably made of a magnetic material.

In the case of the reactor, since a large suction force is exerted between a gap, supporting the centers of the first plate iron core 1 and the second plate iron core 2 allows effectively reducing distortion of the first plate iron core 1 and the second plate iron core 2. Since the suction force is exerted only in the direction of attracting iron cores disposed oppositely through the gap, distortion (variations of the gap) can be effectively reduced also in the direction of a load.

FIG. 7 shows an example in which the three-phase reactor 103 has the cover 5 and the rod member 6, but may have the rod member 6, without having the cover 5.

Figure 8:
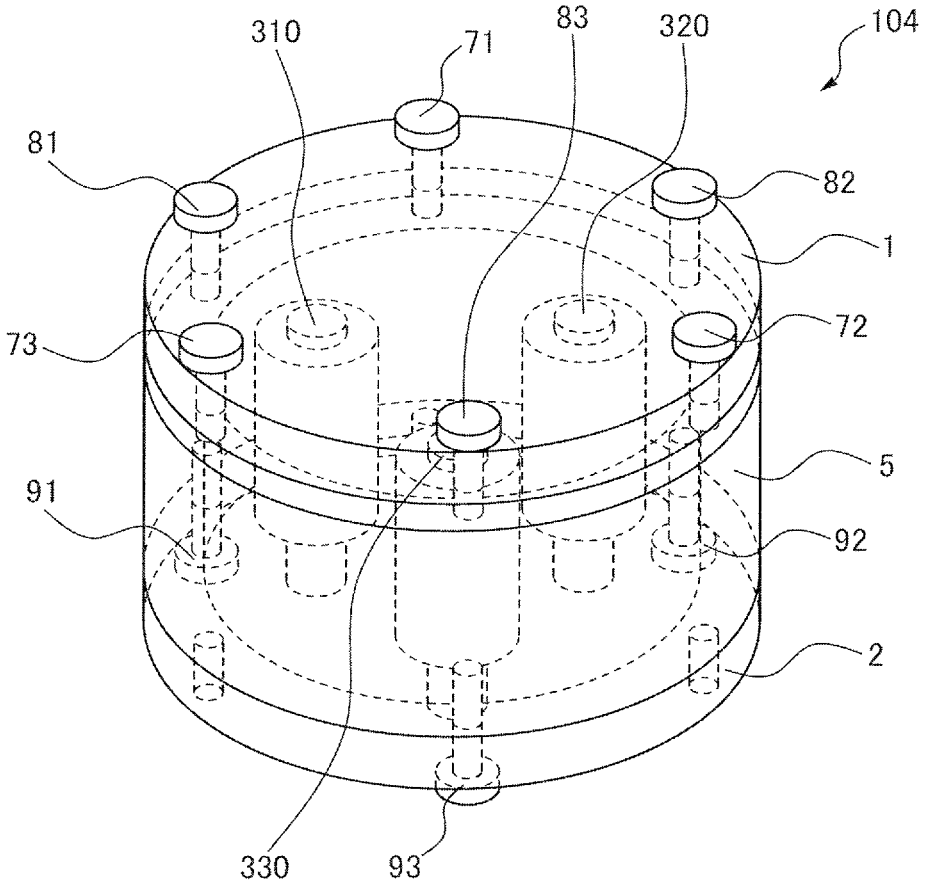
FIG. 8 is a perspective view of a three-phase reactor according to a fourth embodiment.
Figure 9:
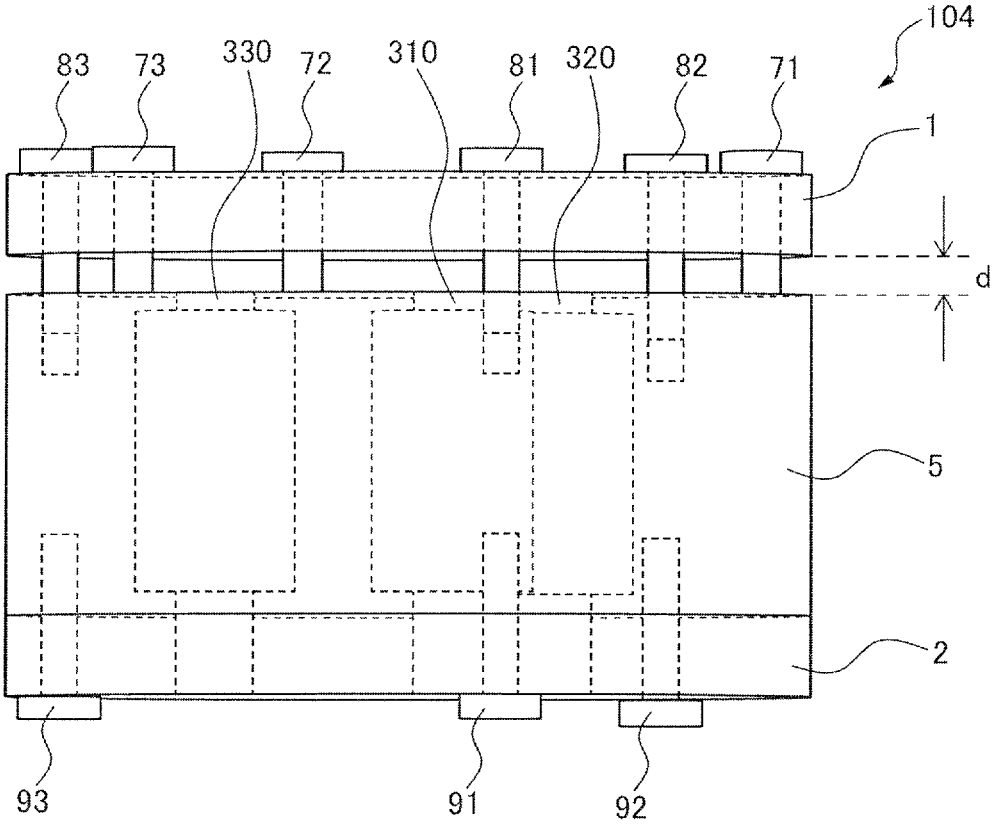
FIG. 9 is a side view of the three-phase reactor according to the fourth embodiment.

Next, a three-phase reactor according to a fourth embodiment will be described. FIG. 8 is a perspective view of the three-phase reactor according to the fourth embodiment. FIG. 9 is a side view of the three-phase reactor according to the fourth embodiment. The difference between a three-phase reactor 104 according to the fourth embodiment and the three-phase reactor 101 according to the first embodiment is that a second gap is formed between at least one of the first plate iron core 1 and the second plate iron core 2 and at least one of a plurality of cores (310, 320, and 330), and gap regulation mechanisms (71, 72, and 73) are provided to regulate the length d of the second gap. The other structure of the three-phase reactor 104 according to the fourth embodiment is the same as that of the three-phase reactor 101 according to the first embodiment, so a detailed description thereof is omitted.

As the gap regulation mechanisms (71, 72, and 73), screws provided in the first plate iron core 1 can be used. The screws contact the cover 5 at their end surfaces. Screw holes are formed in the first plate iron core 1. Turning the screws, functioning as the gap regulation mechanisms (71, 72, and 73), can move the first plate iron core 1 up and down. The second gap d can be formed between the first plate iron core 1 and an end of each of the iron cores (310, 320, and 330), and the size of the second gap d can be regulated by the screws. By regulating the second gap d, the magnitude of an inductance can be finely regulated. It also becomes possible that a single reactor forms inductances of different magnitudes.

As described above, the first plate iron core 1 can be secured only by the screws that function as the gap regulation mechanisms (71, 72, and 73). However, against a magnetic suction force exerted on the second gap d, the first plate iron core 1 and the cover 5 may be secured by screwing first securing screws (81, 82, and 83) into threads formed in the cover 5 through threaded holes formed in the first plate iron core 1, in order to strengthen the coupling. On the other hand, the second plate iron core 2 and the cover 5 may be secured by second securing screws (91, 92, and 93), in order to strength the coupling.

As a gap regulation mechanism other than the screws, a member such as a spacer may be sandwiched between the first plate iron core 1 and the cover 5, and a gap may be formed using securing screws.

The cover 5 is provided in the example of FIGS. 8 and 9. However, in the case of omitting the cover 5, screws functioning as the gap regulation mechanisms (71, 72, and 73) and the securing screws (81, 82, and 83) may penetrate into the second plate iron core 2, to regulate a gap in the same manner as described above.

Figure 10:
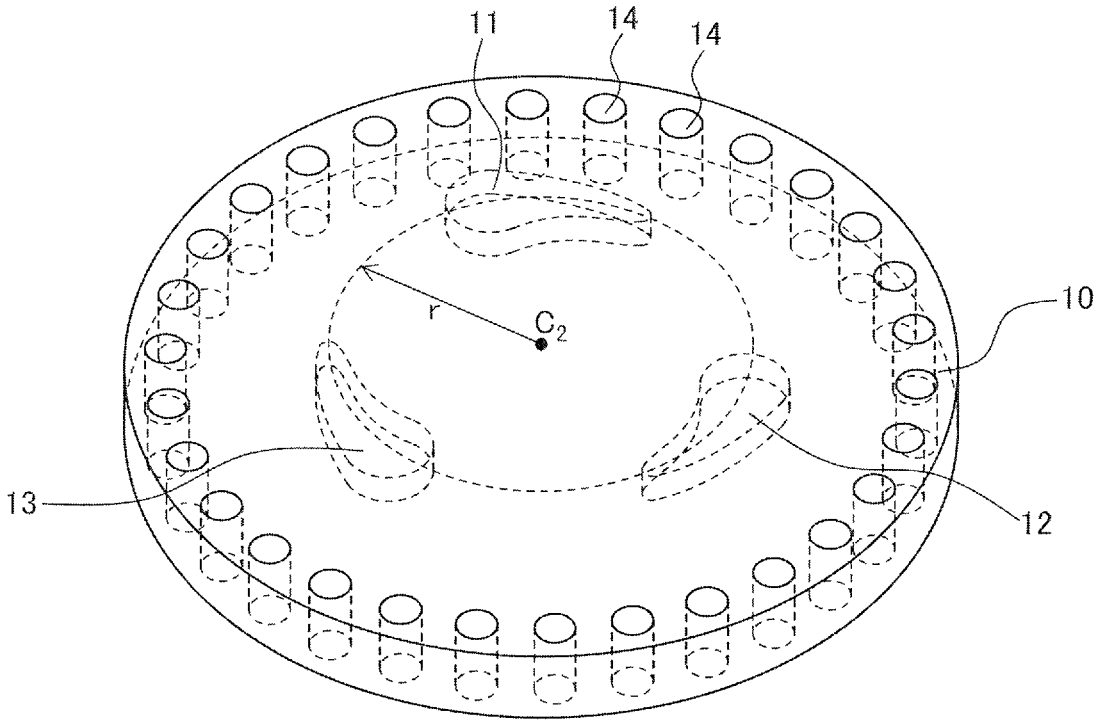
FIG. 10 is a perspective view of a first plate iron core constituting a three-phase reactor according to a modification example of the fourth embodiment.

FIG. 10 is a perspective view of a first plate iron core 10 constituting a three-phase reactor according to a modification example of the fourth embodiment. As gap regulation mechanisms other than the screws, projections (11, 12, and 13), as shown in FIG. 10, are provided in a surface of the first plate iron core 10, opposite iron cores (not illustrated). The projections (11, 12, and 13) are disposed along positions at a distance of r from a rotation center $C_2$ of the first plate iron core 10. Each of the projections (11, 12, and 13) is formed such that its length in a radial direction is shortened in a clockwise direction. In the first plate iron core 10, a plurality of screw holes 14 are provided to regulate position in a circumferential direction. By turning the first plate iron core 10, a contact area between the iron core and each of the projections (11, 12, and 13) is varied intendedly, and an inductance can be thereby regulated.

Figure 11:
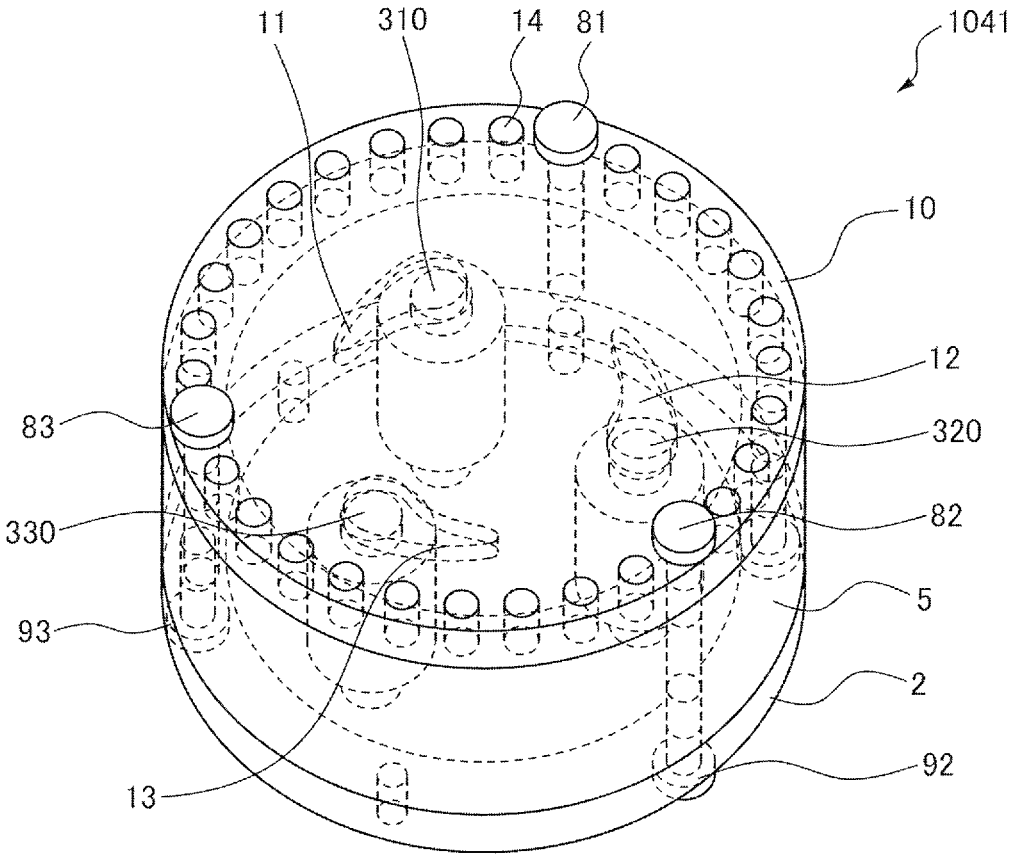
FIG. 11 is a perspective view of the three-phase reactor according to the modification example of the fourth embodiment, illustrating a high inductance state.

FIG. 11 is a perspective view of a three-phase reactor 1041 according to the modification example of the fourth embodiment, illustrating a high inductance state. The projections (11, 12, and 13) contact the iron cores (310, 320, and 330) in positions in which each of the projections (11, 12, and 13) has a maximum length in the radial direction. At this time, an inductance is maximized.

Figure 12:
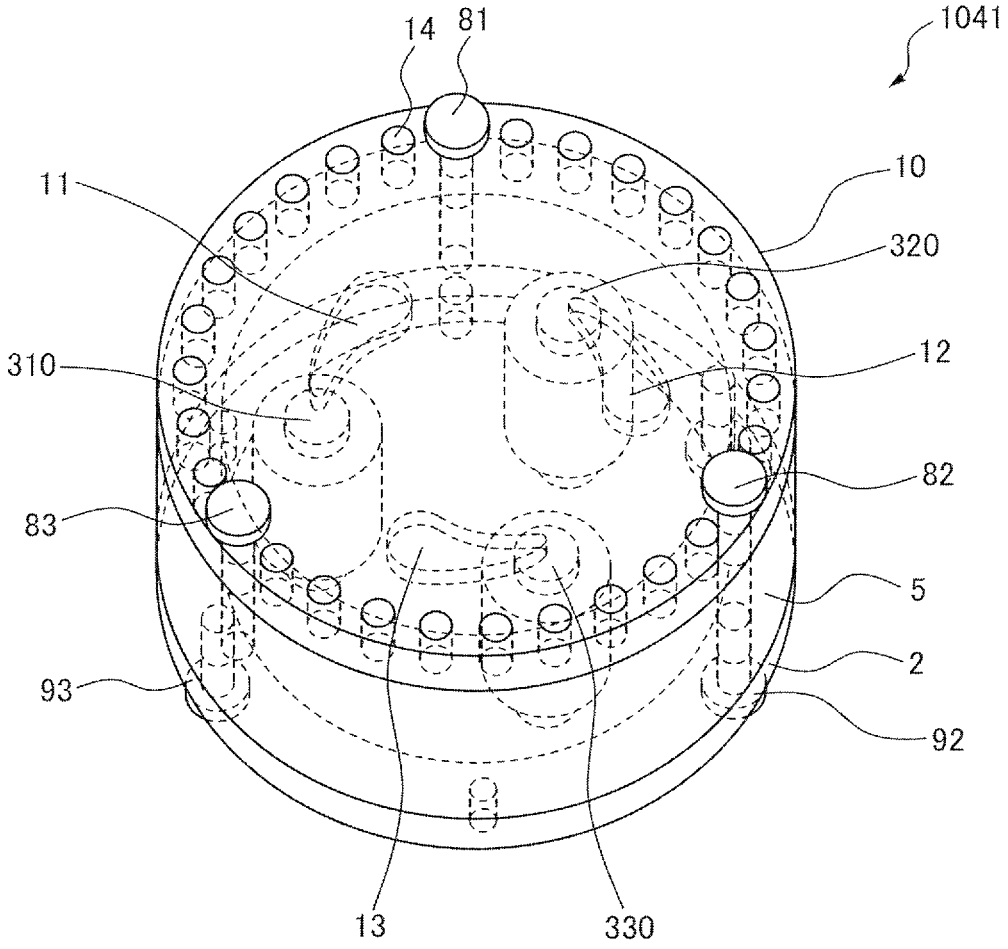
FIG. 12 is a perspective view of the three-phase reactor according to the modification example of the fourth embodiment, illustrating a low inductance state.

FIG. 12 is a perspective view of the three-phase reactor 1041 according to the modification example of the fourth embodiment, illustrating a low inductance state. The projections (11, 12, and 13) contact the iron cores (310, 320, and 330) in positions in which each of the projections (11, 12, and 13) has a minimum length in the radial direction. At this time, an inductance is minimized.

In the structure illustrated in FIGS. 11 and 12, clearances may be closed using members, in order to tightly close the inside of the three-phase reactor 1041 enclosed by the first plate iron core 10, the cover 5, and the second plate iron core 2. The tightly closed structure can provide a measure against leakage flux, electromagnetic waves, dust, etc.

In the three-phase reactors according to the above embodiments, at least one of the first plate iron core 1, the second plate iron core 2, the iron cores (31, 32, and 33), the cover 5, and the rod member 6 may be made of a wound iron core. Furthermore, a rod-shaped central iron core may be disposed at the center of the wound iron core.

Figure 13:
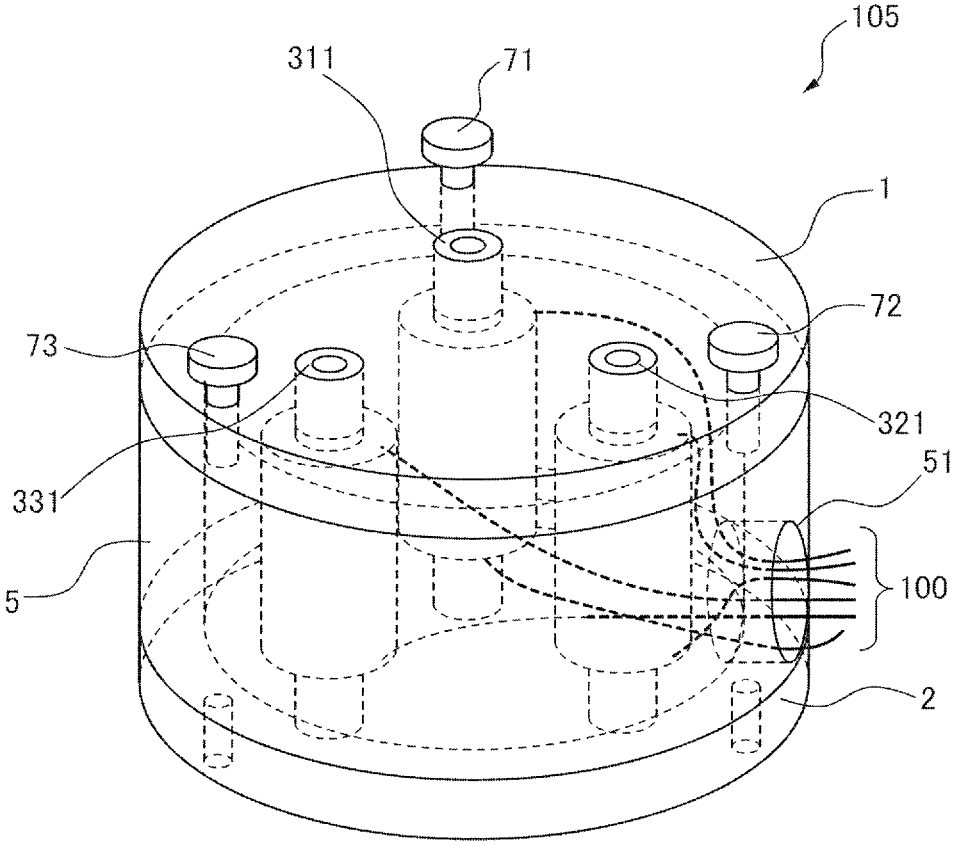
FIG. 13 is a perspective view of a three-phase reactor according to a fifth embodiment.

Next, a three-phase reactor according to a fifth embodiment will be described. FIG. 13 is a perspective view of a three-phase reactor 105 according to the fifth embodiment. The difference between the three-phase reactor 105 according to the fifth embodiment and the three-phase reactor 101 according to the first embodiment is that iron cores (311, 321, and 331) have air-core structures, and the air-core structures are filled with an insulating oil or a magnetic fluid. The other structure of the three-phase reactor 105 according to the fifth embodiment is the same as that of the three-phase reactor 101 according to the first embodiment, so a detailed description thereof is omitted.

The iron cores (311, 321, and 331) penetrate through the first plate iron core 1 and the second plate iron core 2, and the air-core structures extend to the outside of the first plate iron core 1 and the second plate iron core 2. Thus, the insulating oil or the magnetic fluid is flowed into the air-core structures from the side of the first plate iron core 1, and is ejected from the side of the second plate iron core 2.

A cooling water or a cooling oil may be flowed into the air-core structures of the iron cores (311, 321, and 331). This structure allows improvement in cooling performance of the three-phase reactor 105.

FIG. 13 also illustrates wiring 100 of coils wound on the iron cores (311, 321, and 331). A connection portion 51 to take the wiring 100 out of the three-phase reactor 105 is preferably provided in a position that has no effect on magnetic flux. When the three-phase reactor 105 has a tightly closed structure, a connector, a rubber gasket, an adhesive, etc., is used in the connection portion 51, to keep airtightness. The connection portion 51 can be provided in any position, as long as the connection portion 51 has no effect on the magnetic flux, i.e., an inductance.

Each of the three-phase reactors according to the embodiments has a reactance having an increased inductance, by taking advantage of an increased mutual inductance, owing to balanced three-phase power, as well as taking advantage of a self-inductance.

What is claimed is:

1. A three-phase reactor comprising:

a first plate iron core and a second plate iron core disposed oppositely to each other;

a plurality of cylindrical iron cores disposed between the first plate iron core and the second plate iron core orthogonally to the first plate iron core and the second plate iron core, the iron cores being disposed rotationally symmetrically with respect to an axis equidistant from central axes of the iron cores, as a rotation axis;

a plurality of coils each wound on each of the iron cores; and a cover provided on outer peripheries of the first plate iron core and the second plate iron core, wherein a second gap is formed between at least one of the first plate iron core and the second plate iron core and at least one of the iron cores, a gap regulation mechanism is provided to regulate a length of the second gap, and the gap regulation mechanism includes a screw provided in the first plate iron core, and a distal end surface of the screw contacts the cover.

2. The three-phase reactor according to claim 1, wherein the coils are disposed further inwardly than end portions of the first plate iron core and the second plate iron core disposed oppositely.

3. The three-phase reactor according to claim 1, further comprising a rod member disposed such that the axis equidistant from the central axes of the iron cores coincides with a central axis of the rod member.

4. The three-phase reactor according to claim 3, wherein the rod member is made of a magnetic material.

5. The three-phase reactor according to claim 1, wherein a gap regulation mechanism is provided to regulate a length of the second gap.

6. The three-phase reactor according to claim 3, wherein at least one of the first plate iron core, the second plate iron core, the iron cores, and the rod member is made from a wound iron core.

7. The three-phase reactor according to claim 6, wherein a rod-shaped central iron core is disposed at a center of the wound iron core.

8. A three-phase reactor comprising:

a first plate iron core and a second plate iron core disposed oppositely to each other;

a plurality of cylindrical iron cores disposed between the first plate iron core and the second plate iron core orthogonally to the first plate iron core and the second plate iron core, the iron cores being disposed rotationally symmetrically with respect to an axis equidistant from central axes of the iron cores, as a rotation axis;

a plurality of coils each wound on each of the iron cores; and a plurality of projections provided on the first plate iron core which respectively contact the plurality of iron cores, wherein each of the plurality of projections is formed such that its length in a radial direction of the first plate iron core is shortened in a predetermined direction of rotation of the first plate iron core, and a contact area between the iron core and the projections of the first plate iron core is changed by rotating the first plate iron core.

9. The three-phase reactor according to claim 8, further comprising a cover provided on outer peripheries of the first plate iron core and the second plate iron core.

10. The three-phase reactor according to claim 9, wherein the cover is made of a magnetic material or a conductive material.

11. The three-phase reactor according to claim 9, wherein at least one of the first plate iron core, the second plate iron core, the iron cores, and the cover is made from a wound iron core.

* * * * *